United States Patent [19]

Lucas

[11] 4,037,905

[45] July 26, 1977

[54] NO-STRIP ELECTRICAL CONNECTOR

[75] Inventor: James F. Lucas, Sycamore, Ill.

[73] Assignee: Ideal Industries, Inc., Sycamore, Ill.

[21] Appl. No.: 640,252

[22] Filed: Dec. 12, 1975

Related U.S. Application Data

[63] Continuation of Ser. No. 435,107, Jan. 21, 1974, abandoned.

[51] Int. Cl.[2] ..... H01R 13/38

[52] U.S. Cl. ..... 339/98

[58] Field of Search ..... 339/97–99

[56] References Cited

U.S. PATENT DOCUMENTS

| | | | |
|---|---|---|---|
| 2,738,479 | 3/1956 | Gibson | 339/98 |
| 3,605,072 | 9/1971 | Driscoll | 339/98 |
| 3,793,611 | 2/1974 | Johansson et al. | 339/98 |
| 3,820,055 | 6/1974 | Huffnagle et al. | 339/97 P |
| 3,920,305 | 11/1975 | Scott | 339/98 |

*Primary Examiner*—Joseph H. McGlynn
*Attorney, Agent, or Firm*—Kinzer, Plyer, Dorn & McEachran

[57] ABSTRACT

An electrical insulated wire connector in which a through wire and tap wire are held in parallel channels in an insulating body having an integral self-locking cover and opening through its side into which a J-shaped conductive insert with slotted free ends is forced so that its slots penetrate the insulation of the wires and make an electrical connection between them.

14 Claims, 23 Drawing Figures fig.9.
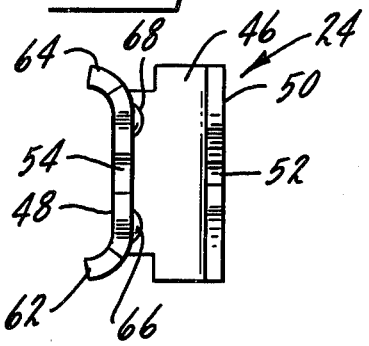
fig.8.
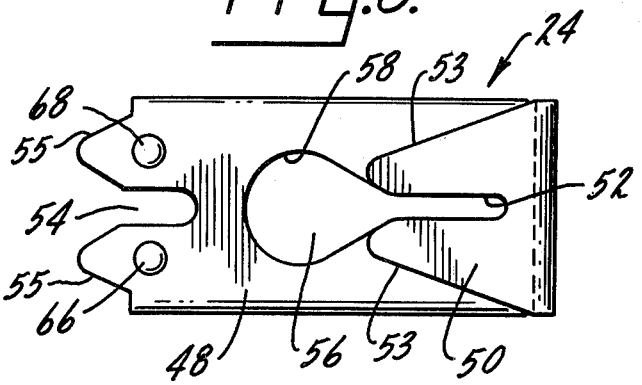
fig.10.
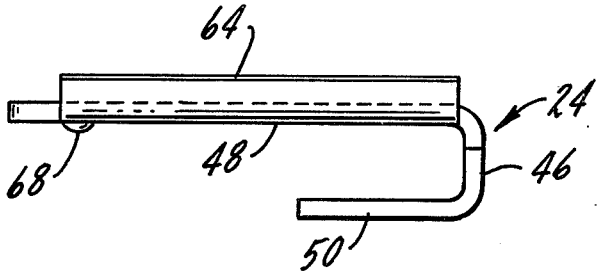
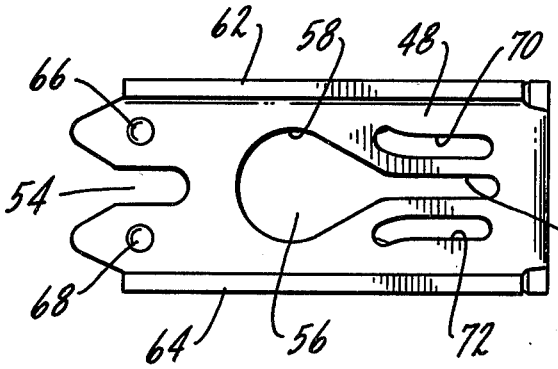
fig.11.

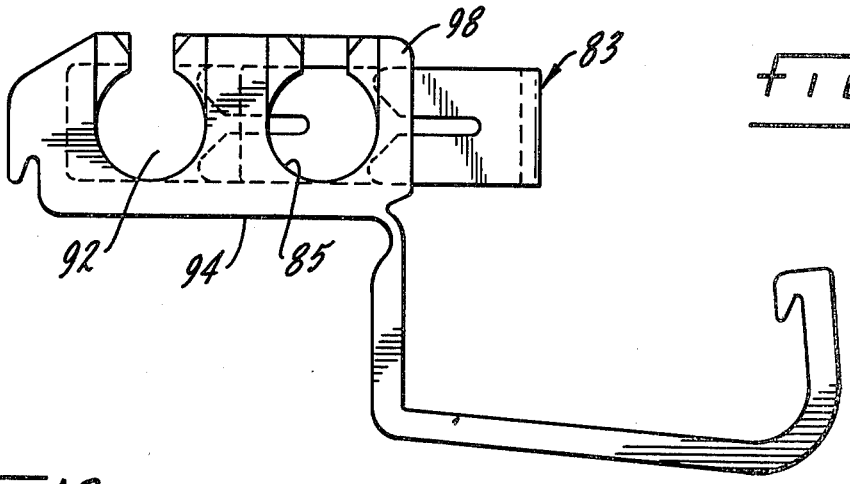
fig.12.
fig.13.
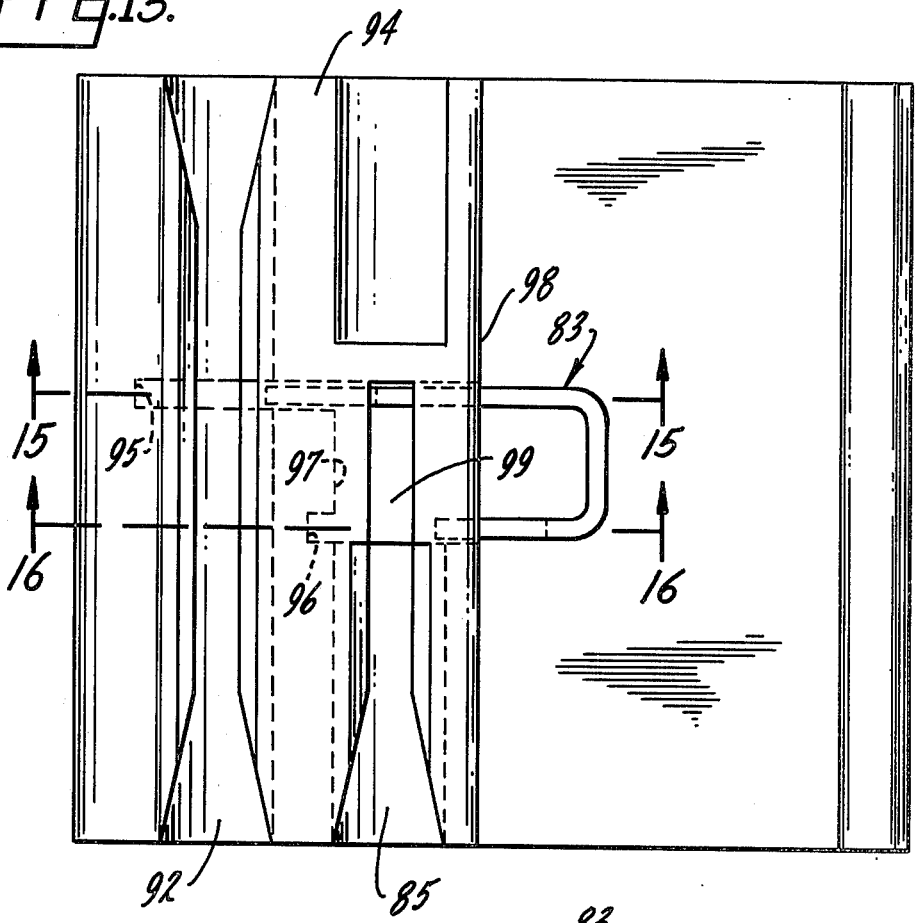
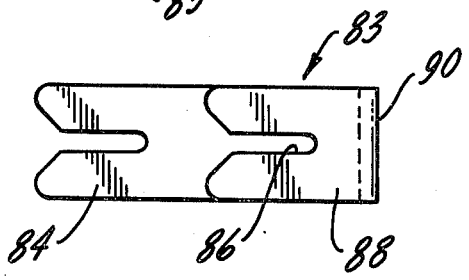
fig.18.

NO-STRIP ELECTRICAL CONNECTOR

This is a continuation of Ser. No. 435,107, filed Jan. 21, 1974, now abandoned.

SUMMARY OF THE INVENTION

The invention is directed to the field of electrical wire connectors and more particularly to a no-strip electrical connector between insulated wires. A connector body of insulating material has two longitudinal wire-receiving channels at least one of which extends through the entire length of the body and is open along the top to receive a through wire. The other channel is for a tap wire and contains a stop surface across it. An opening through the outside wall of the tap wire channel intermediate its length extends into and through both channels for inserting into the side of the connector a J-shaped or tobaggan-shaped conductive insert. Both ends of the insert are slotted to form U-shaped contact members which, when forced into the insulated wires in the channels, penetrate the insulation of the wires and make an electrical connection between them. The insulating body also has an integral self-locking cover to close over the top and side so as to cover the open channels and side opening. Therefore an improved no-strip electrical connector is a primary object of this invention.

Another object is an improved no-strip electrical connector in which the position of the tap wire in the connector body and the joints between the conductive insert and the insulated wires are visible as the connection is made as well as any time thereafter by unlocking and opening the cover.

Another object is an improved no-strip electrical connector in which the cover closes over three sides of the connector, so as to increase the length of the spark path to the latch and make a 600 volt rating possible.

Another object is an improved no-strip electrical connector which incorporates a generally J-shaped insert folded into three portions with both free ends slotted to engage one of the wires held in the connector body.

Another object is an improved no-strip electrical connector in which the insert contains a keyhole-shaped opening through which the tap wire may be inserted without removing the insert from the connector body and which provides a second tap wire piercing channel which effectively doubles the grip of the connector on the tap wire for increased holding strength.

Another object is a connector of the above type which enables the user to see whether or not the tap wire is fully inserted.

Another object is an improved no-strip electrical connector in which one of the inwardly projecting members of the conductive insert is channel shaped for added strength and contains one or more raised dimples to aid in keeping the insert positioned properly in the connector body possibly with recessed areas for these dimples molded into the interior surface of the opening for the insert.

Another object is an improved no-strip electrical connector capable of connecting a variety of wire sizes indiscriminately.

Other objects will appear in the remaining specification, drawings and claims.

BRIEF DESCRIPTION OF THE DRAWINGS

In the Drawings:

FIG. 8 is a front end plan view of the conductive insert;

FIG. 9 is a side plan view of the conductive insert shown in FIG. 8;

FIG. 10 is a top plan view of the conductive insert shown in FIG. 8;

FIG. 11 is a rear end view of the conductive insert;

FIG. 12 is an end plan view of an embodiment without a keyhole-shaped aperture in the conductive insert showing the cover flap open and the conductive insert prepositioned for receiving the tap and through wires;

FIG. 13 is a top plan view of the embodiment shown in FIG. 12;

FIG. 18 is a front end plan view of the conductive insert shown in FIG. 12;

DESCRIPTION OF THE PREFERRED EMBODIMENT

Figure 1:
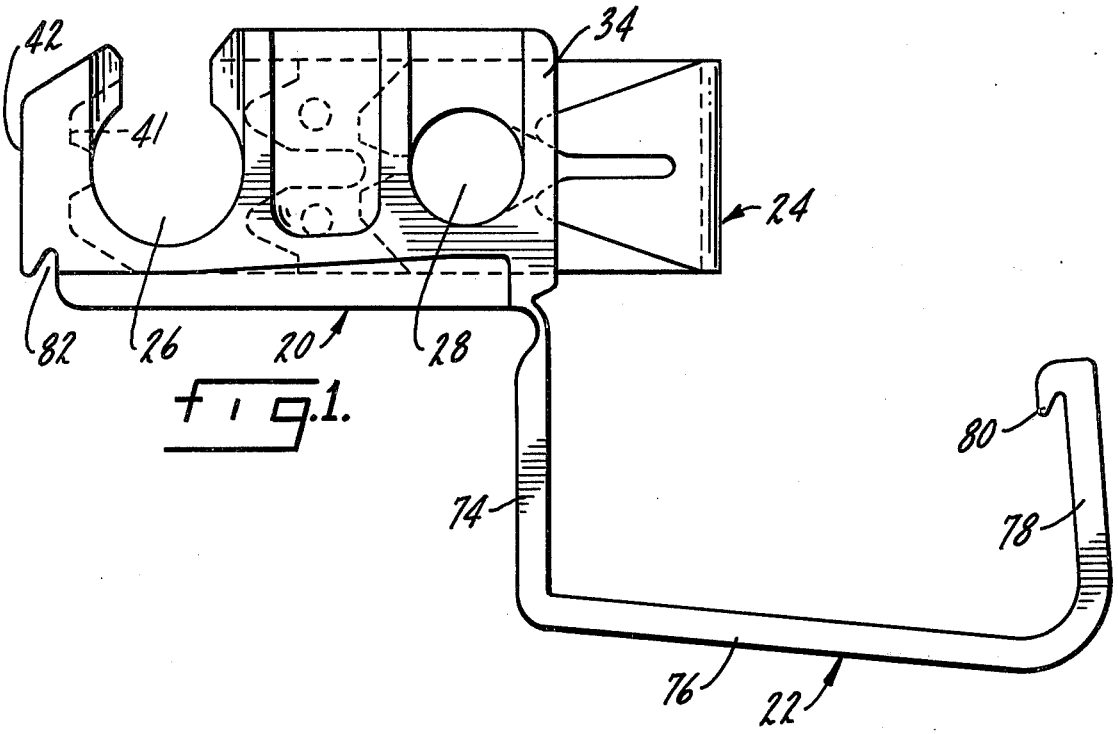
FIG. 1 is an end plan view of the connector showing the cover open and the conductive insert prepositioned within the body for receiving a tap wire through the keyhole aperture of the insert.
Figure 2:
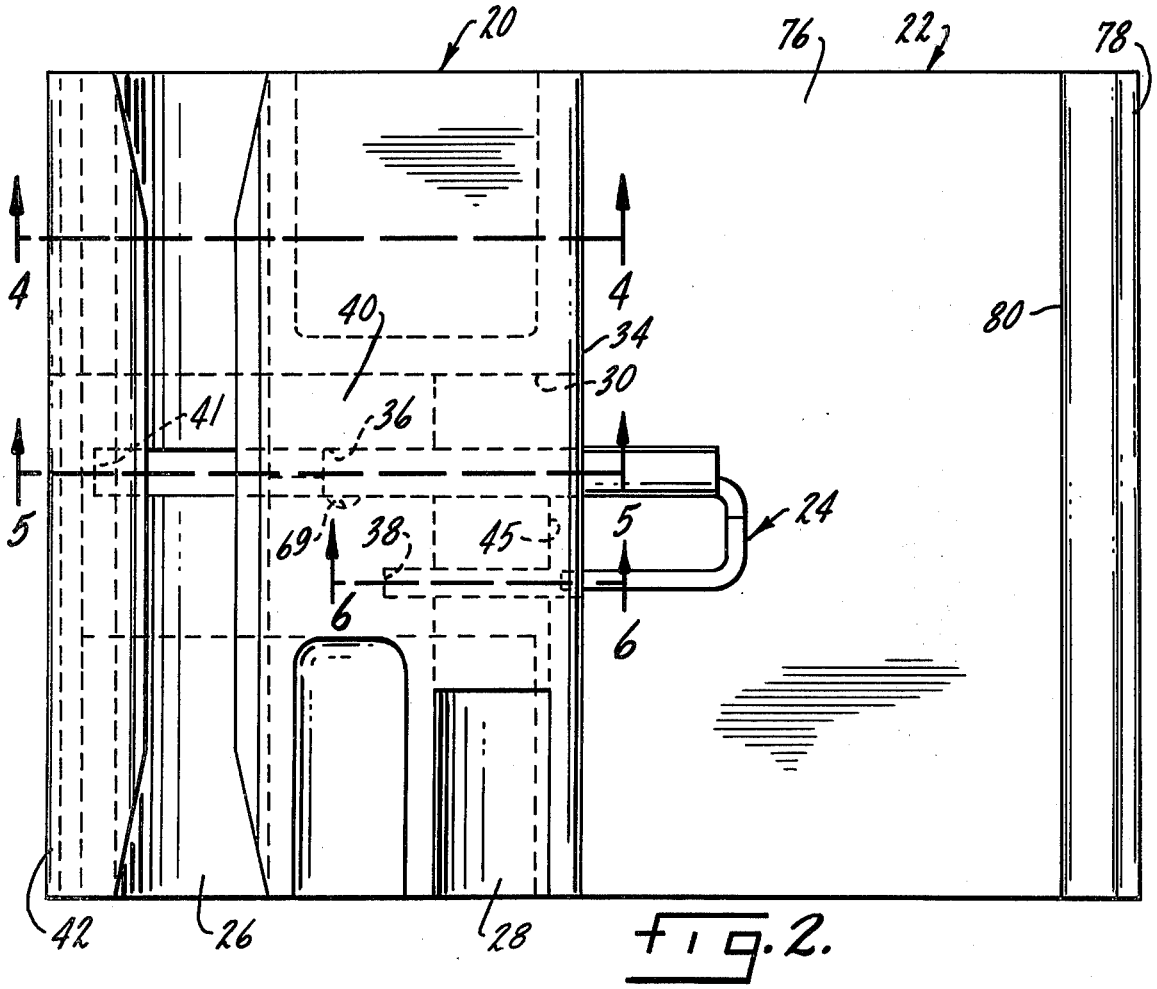
FIG. 2 is a top plan view of the embodiment shown in FIG. 1.
Figure 3:
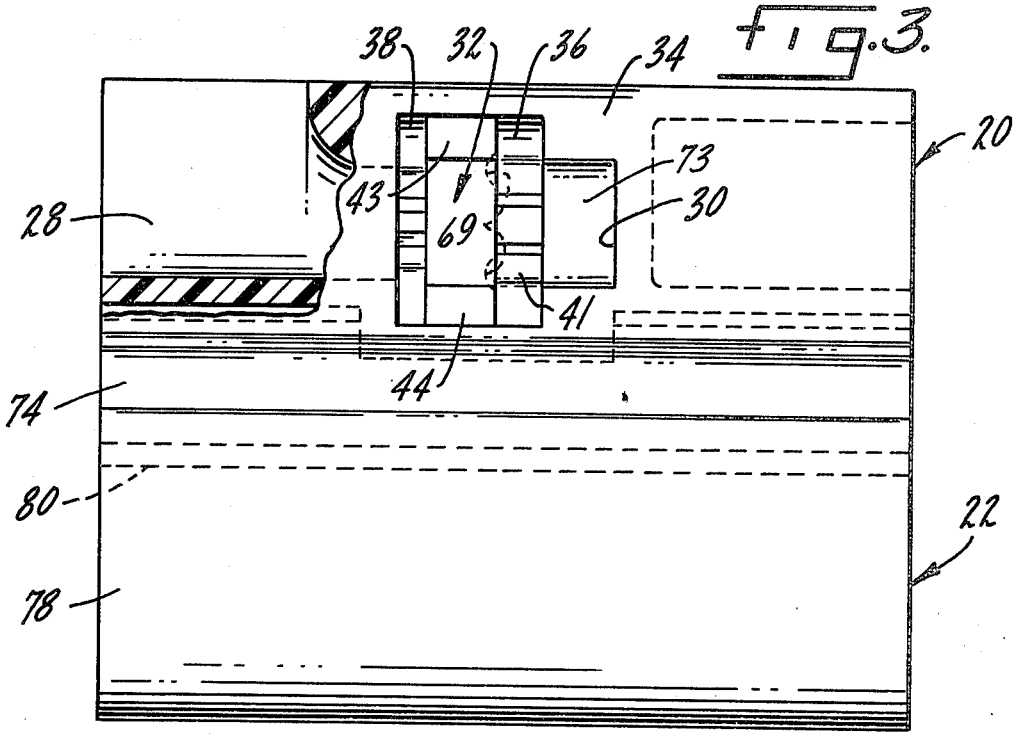
FIG. 3 is a partially fragmented side plan view, partly in section, of the embodiment of FIG. 1 with the insert removed.
Figure 4:
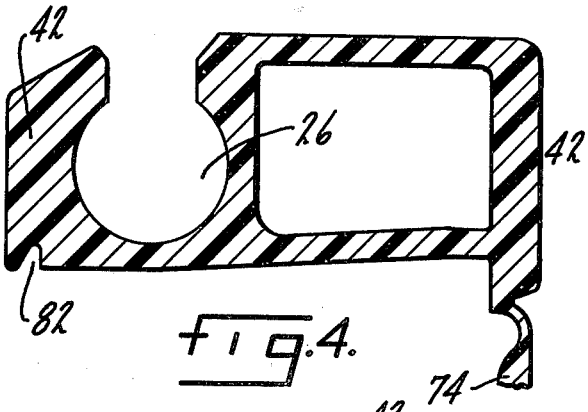
FIG. 4 is a cross section along the line 4—4 of FIG. 2.

A no-strip electrical connector is shown in FIGS. 1-3 comprising a connector body 20 of insulating material with an integral hinged cover 22 and a conductive insert 24.

Figure 5:
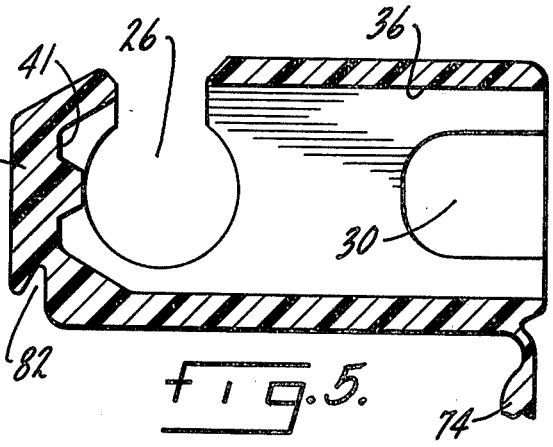
FIG. 5 is a cross section along the line 5—5 of FIG. 2 with the insert removed.
Figure 6:
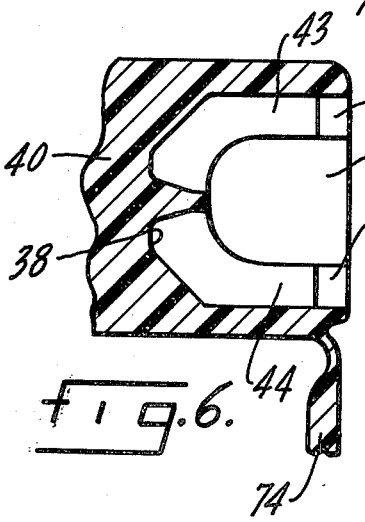
FIG. 6 is a cross section along the line 6—6 of FIG. 2 with the insert removed.

The connector body 20 contains a longitudinal channel 26 for receiving an insulated through wire. The channel extends through the entire length of the body 20 and is open along the top. Another longitudinal parallel channel 28 shown in FIGS. 1-3 is for a tap wire and contains a stop surface 30 which the fully inserted tap wire abuts. The connector body has a side opening 32 through the outside wall 34 of the tap wire channel 28 intermediate its length. In the embodiment shown in FIGS. 1–3 two parallel transverse slots 36 and 38 extend into the body of the connector 20 from the side opening 32 to receive the free ends of the conductive insert. The longer slot 36 extends through the portion 40 of the connector body between the channels, into and through the wire channel 26 and into sockets 41 but not through the closed side 42 of the connector body. The shorter slot 38 extends into but not through the portion of the connector body 40 between the channels. Both slots are tall and thin in cross-section and the longer slot is wider than the shorter slot because of the channel shape of the member of the insert it is to receive. The depths and shapes of the parallel slots 36 and 38 in the connector body are shown in FIGS. 5 and 6 respectively. The area between slots 36 and 38 contains support members 43 and 44 above and below, each of which is set back somewhat, as at 45, by a distance at least equal to the thickness of the outer part or piece of the conductive insert so that it will be countersunk and will lie flush when fully inserted.

A generally J or tobaggan-shaped conductive insert 24 is adapted to be slidably retained and inserted into the side opening 32 and parallel slots 36 and 38 of the conductive body. The insert 24 is folded into three portions: a generally flat outer base 46 generally normal to two generally parallel inwardly projecting contact members 48 and 50. The difference between the lengths of the contact members 48 and 50 is approximately equal to the distance between the center lines of the channels 26 and 28. A slot 52 is cut or otherwise formed into the end of the shorter member 50 about as deep as the width of the tap wire slot 28 with a width significantly less than the diameter of the smallest tap wire conductor with the outer edges of member 50 being tapered as at 53. The longer member 48 has a slot 54 in the center of its free end about as deep as the width of the through wire channel 26 with a width significantly less than the conductor of the through wire to be inserted with the outer edges of member 48 also being tapered as at 55. The longer member 48 also contains a keyhole-shaped aperture 56 which contains the tap wire prior to making a connection and consists of a hole 58 and a channel or extension 60 as is shown in FIG. 11. The diameter of the hole 58 is approximately equal to the width of the tap wire channel 28. The channel 60 extends outward from the hole 58 toward the base 46 of the insert and has a width equal to or less than the width of slot 52 and a length about equal to or greater than the length of the shorter contact member 50. The aperture 56 is positioned on the longer member 48 so that the center of the hole 58 of the aperture 56 is positioned in line with the center line of the tap wire channel 28 when the free end of the longer contact member 48 is inserted into its slot 36 about as far as the innermost surface of the through wire channel 26. With the insert 24 so prepositioned, the tap wire can be received in the tap wire channel 28 through the keyhole-shaped aperture 56 of the insert 24 until it abuts against the stop member 30, thus making it unnecessary to remove the insert 24 from the connector body 20 in order to receive the tap wire. The hole is desirable since the insert must have support on both sides of the wire opening in order to successfully transmit the force required for the insert to connect to the through wire.

Furthermore, in the embodiment of the conductive insert shown in FIGS. 8–11, the edges of the insert 24 at the slotted ends of the contact members 48 and 50 are tapered in toward the slots 52 and 54 to facilitate expansion of the insert when it makes contact with a large wire which results in permanent deflection. The wire-engaging open ends of the slots 52, 54 and channel 60 in the conductive insert 24 are flared away from their center lines to aid in guiding their sides over the conductor wires as the insert is pressed through the insulation so as to prevent any part of the insert adjacent to the open end from abutting directly against a connector wire. Also, the widened edges 62 and 64 of the longer contact member 48 are folded away from the shorter member 50 normal to the surface of the longer member 48, thus imparting to that member a channel shape for added strength. Raised dimples 66 and 68 are formed into the free end of the longer contact member 48 adjacent the end slot 54 to aid in keeping the insert 24 positioned properly in the connector body 20 by resisting movement of the insert. Recessed dimples 69 may be provided on the interior surface of slot 36 to mate with the raised dimples on the insert thereby insuring that the insert will be properly and securely positioned in the connector body 20. Two additional openings 70 and 72 have been cut into the longer contact member 48 of the insert adjacent to the slot 60 of the keyhole aperture 56 and conforming generally thereto. These apertures are of approximately the same size as the channel 60 of the keyhole aperture 56 and have their inner ends flared away from the center line of the insert. These openings 70 and 72 allow some lateral distortion of the keyhole channel 60 as it is forced over an insulated tap wire and thus prevent cutting strands on the larger tap wires and reduce the force necessary to make a connection with larger wire sizes.

The tap wire channel 28 is open as at 73 through side 34 between the metal insert 24 and wire stop 30 allowing the position of the tap wire to be viewed both before and after the conductive insert has been inserted. At present it is easy to make a connection without having the tap wire in the proper place. This also has the advantage that the part is easier to mold since the portion of the wire slot between the brass or metal insert and the wire stop is put in by the same sliding mold insert which makes the side openings for the metal insert.

Figure 7:
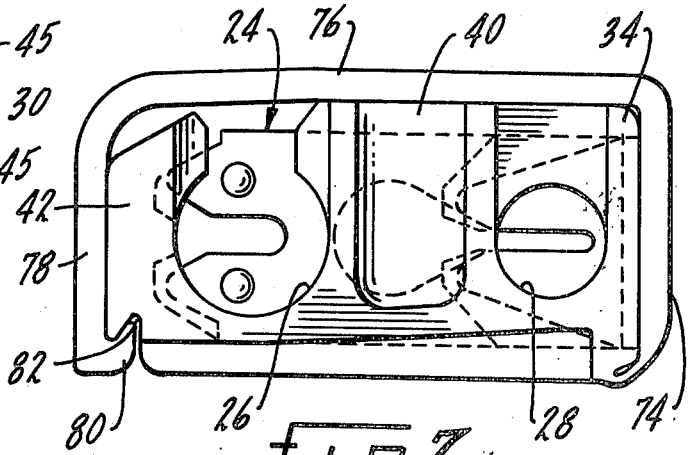
FIG. 7 is an end plan view of the embodiment shown in FIG. 1 with the conductive insert fully inserted into the connector body and the cover locked in closed position.

The cover flap 22 which is an integral part of the connector body 20 is hinged along the bottom edge of the side of the connector body containing the insert opening 32. The cover 22 is an integral unit folded into three portions 74, 76 and 78, the first 74 to cover the side of the connector 34 in which the insert has been inserted, a second 76 to cover the top of the connector containing the open wire-receiving channels 26 and 28, and the third 78 to cover the closed side 42 of the connector body. The means for locking the cover 22 into closed position over the three sides in the embodiment shown in FIGS. 1–3 consists of a cover latch 80 extending along the inside edge of the free end of the cover flap and a matching continuous groove 82 along the bottom edge of the closed side 42 of the connector body. The cover flap 22 is shown in its closed and locked position over the connector body 20 in FIG. 7. The angle between 74 and 76 is greater than 90° so as to pull or preload latch 20 into groove 82 when the cover is closed and locked. Similarly, the angle between 76 and 78 is less than 90° so as to pull 78 toward surface 42 of the connector body 20 and thus tend to hold the cover 22 in its closed and locked position as shown in FIG. 7.

Figure 14:
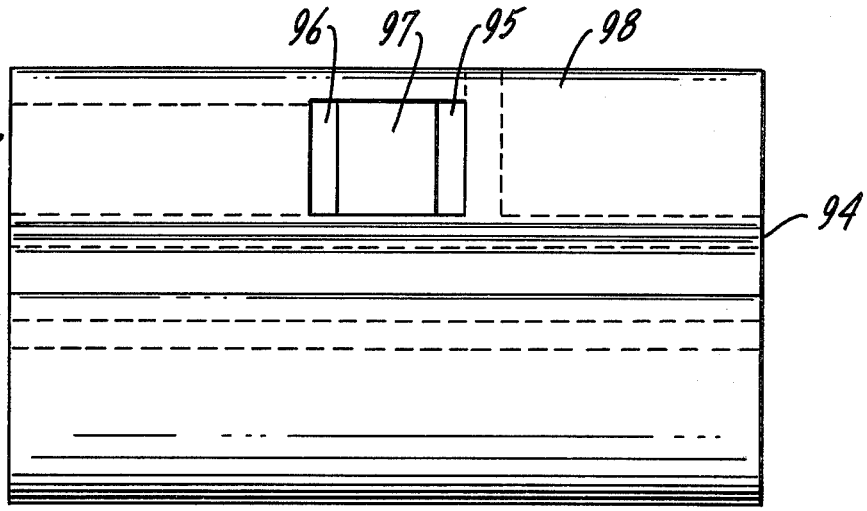
FIG. 14 is a side plan view of the embodiment shown in FIG. 12 with the insert removed.
Figure 17:
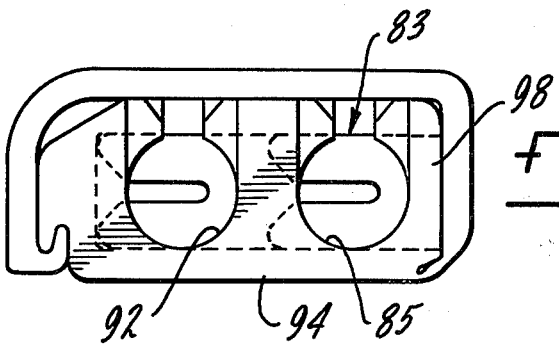
FIG. 17 is an end plan view of the embodiment of FIG. 12 with the conductive insert fully inserted into the connector body and the cover locked into closed position.
Figure 15:
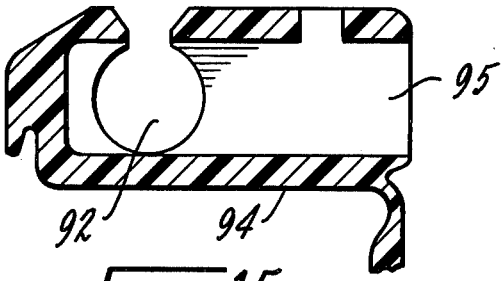
FIG. 15 is a transverse cross-section of a portion of the connector taken along line 15—15 of FIG. 13 with the insert removed.
Figure 16:
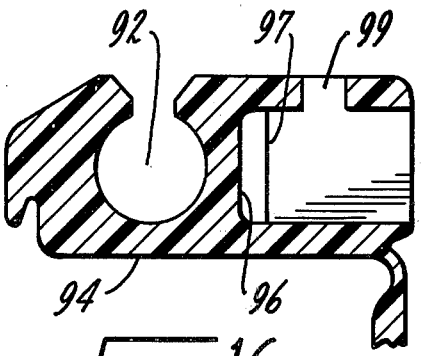
FIG. 16 is a transverse cross-section of a portion of the connector taken along line 16—16 of FIG. 13 with the insert removed.
Figure 19:
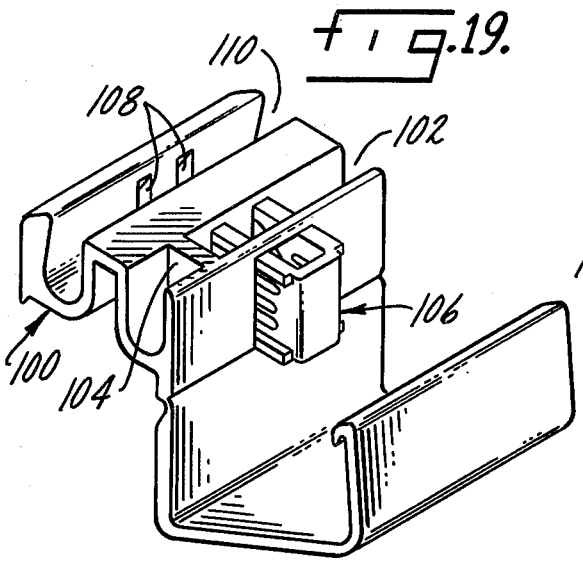
FIG. 19 is a perspective of a further variant, shown open.
Figure 20:
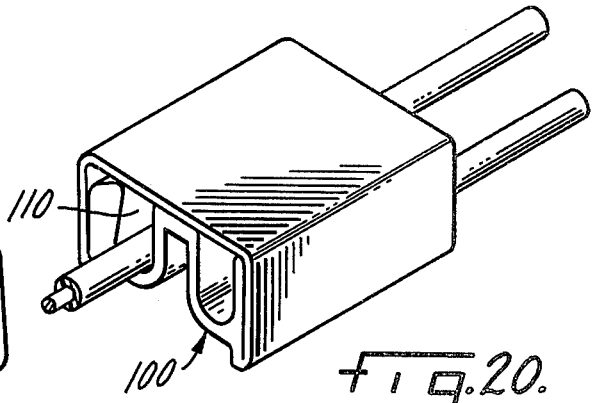
FIG. 20 is like FIG. 19 but closed and with wires.
Figure 22:
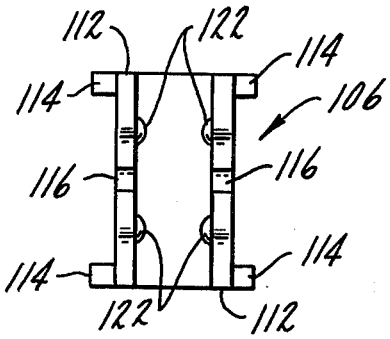
FIG. 22 is an end view of FIG. 21.
Figure 21:
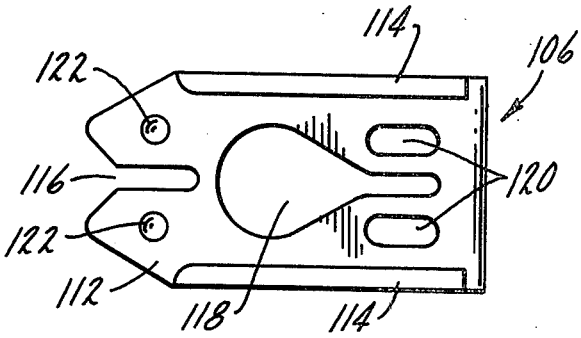
FIG. 21 is a front view of the insert in FIG. 19.
Figure 23:
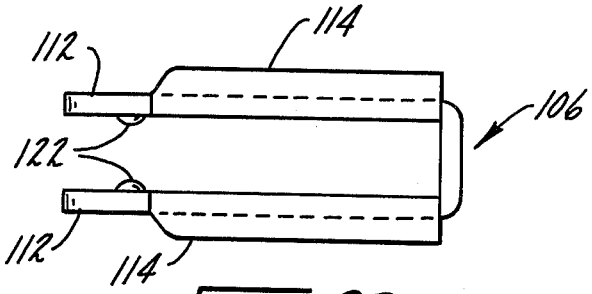
FIG. 23 is a top view of the insert of FIG. 21.

A different embodiment of the invention is shown in FIGS. 12–14 wherein there is no keyhole aperture cut into the conductive insert 83. In this embodiment also, the conductive insert 83 may be prepositioned in the connector body for receiving a tap wire. Since the tap wire cannot pass through any hole in the insert 83, the flat inner portion of the longer contact member 84 acts as the stopping surface in the tap wire channel 85 and only the end slot 86 of the shorter contact member 88 of the insert engages the tap wire in electrical contact. The advantage of this embodiment is that the overall size of the connector is reduced in two ways. First, the distance between the wires can be reduced since it is no longer necessary to have the wire attached through the insert between the two slots. In addition, the insert does not have to be wider than the slot diameter. The simplified construction of the insert 83 shown in FIG. 18 consists of a flat outer base 90 and inwardly projecting U-shaped contact members 84 and 88 the first longer than the other by a distance approximately equal to the distance between the channels 85 and 92 of the connector body 94. The shape of the slots 95 and 96 in the connector body and the opening 97 in the side 98 of the connector body are shown in FIGS. 15 and 16. FIG. 17 shows the cover flap in closed and locked position over the connector body with the conductive insert 83 in its fully inserted position.

In this form the tap wire channel 85 is open on top up to the stop surface thereby providing a top window 99 for viewing the tap wire where it is inserted. Otherwise, the user has to go by "feel" and it's very easy to make a connection without having the tap wire in properly.

The material used for the connector body with its integral hinged cover may be a flame retardent polypropylene or any suitable thermo-plastic. This portion of the connector is most easily produced by injection molding. A preferred material for the conductive insert is a tin plated hard cartridge brass although any resilient conductive material may be used.

Although a connector designed for joining only two wires has been shown, other embodiments of the present invention may be constructed to connect three or more wires by increasing the number of tap wire channels in the connector body and wire-engaging slots in the conductive insert.

For example, in the forms shown in FIGS. 19–23 the insulator or housing 100 has the channel 102 for the tap wire opening in the opposite direction with a stop wall or insulating abutment 104 oppositely positioned. In this regard, the previous forms or example could be reversed also. The cross channels or openings for the insert 106 extend all the way through into sockets 108 on the far side of the through wire channel 110. This is to say that both slots or cross channels extend all the way through instead of only one, so that the insert 106 has both legs of the same length, or approximately so. For example, in FIGS. 21–23 the legs 112 are generally of the same length so that each extends all the way through the tap wire channel, through the intermediate mass of insulating material between the two channels, across the through wire channel with the tips or ends of the legs socketing into the indents or depressions 108, in FIG. 19, in the far side of the through wire channel. Each of the legs 112 may have the longitudinal marginal edges rolled over or deformed into flanges 114 and in the form of FIGS. 21–23 these flanges extend outwardly, although they could extend inwardly between the legs. In any event, each leg of the insert is further strengthened or formed into a channel, similar to the single leg of FIGS. 9–11, so that when the insert is being forced in and cutting the insulation of the wires, a column effect for maximum strength is provided so that the insert will not collapse or buckle. It will be noted that each leg of the insert is formed the same as or similar to the single long leg of the insert of FIGS. 8–11 with a slot in the end thereof, as at 116, for cutting the insulation and engaging the through wire and a keyhole 118 with relieving apertures 120 on one or both sides thereof for cutting the insulation and engaging the tap wire. The aligning or guiding dimples or projections 122 have been shown on the inside between the legs, but they might be on the outside. In the form of FIGS. 19–23 the insulating housing between the legs may be formed with the bosses or guidance bosses between the legs to prevent them from collapsing when the insert is being forced inwardly by a pair of pliers or any other suitable hand tool.

The tap wire channel 102 is open on top to provide a window for viewing the tap wire as it is inserted so that the user does not have to operate by "feel" but rather can make sure the tap wire is fully inserted.

The use, operation and function of my invention are as follows:

The connection is made by forcing the U- or J-shaped conductive member or insert into the side of the plastic housing and biting into both the through wire and the tap wire. The open upper channel where the through wire is positioned and/or the window 73 in the side of the connector body have the advantage that full visibility is available during the connection process. The cover is hinged at the corner below the insert opening and covers three sides of the connector or body in such a way that the spark gap from the conductive insert to the exterior of the plastic housing is at a maximum when the cover is closed, thereby allowing a greater or higher voltage rating for the connector. The geometry and shaping of the cover with the links or panels thereof being at greater than and less than 90° respectively provide a self-locking or preloading aspect to the cover when it is full locked, with the relationship being such that the surfaces of the cover will be pulled tightly over the exposed openings in the main part of the housing or body.

Four different forms or types of inserts are specifically shown with each having advantages for particular application. The keyhole approach, whether it is in one or both legs of the insert, gives greatly increased strength or resistance to pullout by allowing a wire to be connected in two places. If the keyhole is eliminated, then the simple form of J-shaped insert is used and the overall size of the resulting connector can be greatly reduced. The channel shaping of either one or both legs of the insert greatly increases strength. The raised dimples may be used in certain styles or designs for proper positioning of the insert in the cross channels.

Where a simple insert is used, such as in FIG. 18, without a keyhole, the size of the overall connector is reduced in two ways, first, the distance between the wire receiving channels may be reduced since it is no longer necessary to have the wire pass through the insert between the two slots, and, second, the insert does not have to be wider or higher than the wire diameter.

The guiding lugs between the legs of the insert in the side opening insure that when the insert is compressed inwardly by hand pliers, this will reduce the tendency of one leg to fold over or collapse on the other. The column strength acquired in either one or both legs by folding over or bending the longitudinal edges, as in FIGS. 8–11, greatly stiffens the insert so that it won't collapse.

In the FIGS. 1–11 form, as well as the others, the legs of the metal insert are tapered on top and bottom, as at 53 and 55, so that the insert will still fit in the transverse slots in the insulating body after the inserts have been formed over the wires. When the insert is forced over a wire to make a connection, the legs of the insert tend to expand. But tapering the top and bottom leading edges will counteract this.

While a preferred form and several variations of the invention have been disclosed, it should be understood that suitable additional modifications, changes, substitutions and variations may be made without departing from the scope of the invention.

I claim:

1. A no-strip electrical connector comprising a connector body of insulating material with two longitudinal wire-receiving channels, at least one of which extends throughout the entire length of the body and opens along a top longitudinal surface of the body to accept a through wire, the other channel being for a tap wire and being also bordered by the top surface of the body and containing a generally transverse stop surface, the connector body having side openings disposed intermediate the length of the tap wire channel through a longitudinal side of the body normal to the top surface and adjacent the tap wire channel and through the connector body between the channel, and a generally bent-over, two-legged conductive insert for inserting into the opening in the side of the connector body, both ends of the insert being slotted to form U-shaped contact members on the ends thereof which, when simultaneously forced into the insulated wires lying in the channels, penetrate the insulation of the wires and make an electrical contact between them, one leg of the insert being longer than the other and being adapted to engage the through wire lying in the through wire channel, the shorter leg being adapted to engage the tap wire lying in the tap wire channel when the insert is forced into the connector body, said connector body having as an integral part thereof a hinged cover flap with means for locking it in a closed position over the top and side of the body so as to cover the channels and side opening.

2. The no-strip electrical connector of claim 1 wherein the tap wire channel is of smaller diameter than the through wire channel and the slot in the shorter leg of the conductive insert is narrower than the slot in the longer leg so that a tap wire of smaller diameter than the through wire may be connected thereto.

3. The no-strip electrical connector of claim 1 wherein the opening through the side of the body adjacent the tap wire channel is wider than the outer exposed surface of the conductive insert so that the position of the tap wire within the connector body can be viewed both before and after the conductive insert has been inserted.

4. A no-strip electrical connector of claim 1 wherein the attached cover is hinged along the bottom edge of the side of the connector body containing the insert opening; said cover being an integral unit folded into three portions, the first to cover the side of the connector in which the insert has been inserted, the second to cover the top of the connector containing the wire-receiving channels, and the third to cover the closed side of the connector body, said connector having a means for locking the cover into closed position over the three sides.

5. The no-strip electrical connector of claim 1 wherein the longer contact leg of the conductive insert contains a keyhole-shaped aperture consisting of a hole allowing passage of the tap wire through the insert and an additional slot protruding outward therefrom for piercing the insulation of the tap wire, said additional slot having generally similar dimensions as those of the slot in the shorter contact leg.

6. The no-strip electrical connector of claim 5 wherein the metallic conductive insert has a generally flat outer base generally normal to the parallel inwardly projecting contact legs, the difference between the lengths of the legs being generally equal to the distance between the center lines of the channels, the end of the shorter leg having a slot less than the width of the conductor of the smallest tap wire and generally as deep as the width of the tap wire channel, the end of the longer leg having a slot generally less than the width of the conductor of the smallest through wire and generally as deep as the width of the through wire channel, the longer leg containing a keyhole-shaped aperture consisting of a hole and slot, said hole being generally equal in diameter to the width of the tap wire channel, said slot extending outward therefrom and having generally similar dimensions as those of the slot in the shorter contact leg, said aperture being positioned on the longer leg such that with the free end of the longer leg at the point of initial contact with the through wire channel the center of the hole of the aperture is positioned generally in line with the center line of the tap wire channel.

7. The no-strip electrical connector of claim 6 wherein the sides of one of the contact legs are folded outward generally normal to the surface of the leg so as to impart a channel shape to the leg for added strength.

8. The no-strip electrical connector of claim 6 wherein raised dimples are formed on the insert to keep the insert positioned properly in the connector body.

9. The no-strip electrical connector of claim 8 wherein recessed dimples are formed on the interior surface of the side opening to mate with the raised dimples on the insert thereby properly positioning the insert in the connector body and retaining it there until the connector is used.

10. In a no-strip electrical connector, a connector body of insulating material with two longitudinal wire-receiving channels, at least one of which extends throughout the entire length of the body and opens along a top longitudinal surface of the body to accept a through wire, the other channel being for a tap wire and being also bordered by the top surface of the body and having a generally transverse stop surface therein, the body having side openings disposed intermediate the length of the tap wire channel and opening through a longitudinal side of the body generally normal to the top surface and adjacent the tap wire channel and through the connector body between the channels, and a generally U-shaped conductive insert positioned in the openings in the side of the body with two legs, the ends of which are slotted to form U-shaped contact members which, when the insert is forced into the body with the slots straddling and overlying the wires positioned in the channels, penetrate the insulation of the wires establishing electrical contact between them, one leg being longer than the other, the longer leg being adapted to engage an insulating wire lying in the through wire channel and the shorter leg being adapted to engage an insulating wire lying in the tap wire channel when the insert is forced into the connector body.

11. The structure of claim 10 further characterized in that the other channel for the tap wire is open along the top thereof at least to the stop surface.

12. The structure of claim 10 further characterized by and including a second longitudinal side of the body generally normal to the top surface, a socket in the second side at the end of and aligned with a side opening to receive the ends of one of the insert legs.

13. In a no-strip connector for connecting a tap wire to a through wire, a connector body of insulating material having two longitudinal wire-receiving channels therein, one channel being for a through wire and being open throughout its length along one surface of the connector body and the other channel being for a tap wire to be inserted from one end and being bordered by said one surface of the body and interrupted by a stop surface intermediate the length of the connector body, a lateral passage in the connector body opening through both channels and a longitudinal side surface of the body adjacent said one surface, a movable U-shaped two-legged metal insert in the lateral passage constructed and arranged to be compressed by a hand tool into and through the channels along a line through both channels and generally normal thereto to connect the tap wire to the through wire, one leg being longer than the other, the longer leg being adapted to engage the wire in the through wire channel and the shorter leg being adapted to engage a wire in the tap wire channel when the insert is forced into the connector body, and an opening in the connector body providing visual access to the tap wire channel at a location between the stop surface and the lateral passage.

14. In a no-strip connector for connecting a tap wire to a through wire, a connector body of insulating material having two longitudinal wire-receiving channels therein, one channel being for a through wire and being open throughout its length along one surface of the connector body and the other channel being for a tap wire to be inserted from one end and being interrupted by a stop surface intermediate the length of the connector body, a common longitudinal side of the body bordering on both channels, a lateral passage in the connector body opening through both channels and a longitudinal side of the body adjacent said common side, and a generally bent-over two-legged movable metal insert therein constructed and arranged to be compressed by a hand tool into and across the channels along a line intersecting both channels to connect the tap wire to the through wire, one leg being longer than the other, the longer leg being adapted to engage the through wire lying in the through wire channel and the shorter leg being adapted to engage the tap wire lying in the tap wire channel when the insert is forced into the connector body, the ends of the legs being slotted to form U-shaped contact members, the leading edge of the insert being tapered top and bottom to overcome any tendency of the insert to jam during insertion due to expansion of the U-shaped contact member as it is forced over a wire.

* * * * *